United States Patent [19]

Hinton et al.

[11] Patent Number: 5,068,647

[45] Date of Patent: Nov. 26, 1991

[54] DIGITAL BLANKER FOR SCANNED DISPLAYS

[75] Inventors: Mark L. Hinton, Bellevue, Wash.; John C. Belka, Jr., Shawnee, Kans.

[73] Assignee: Allied-Signal Inc., Morris Township, Morris County, N.J.

[21] Appl. No.: 331,912

[22] Filed: Apr. 3, 1989

[51] Int. Cl.[5] ..... G09G 1/00

[52] U.S. Cl. ..... 340/734; 340/732; 340/744; 315/386

[58] Field of Search ..... 340/732, 733, 736, 739, 340/740, 743, 721, 734, 744, 707; 315/386, 365, 377; 358/22, 182, 183

[56] References Cited

U.S. PATENT DOCUMENTS 4,472,707 9/1984 Wilensky et al. ..... 340/736 OR 4,635,050 1/1987 Grothe et al. ..... 340/734 OR 4,663,618 5/1987 Hayles et al. ..... 340/732 OR 4,899,139 2/1990 Ishimochi et al. ..... 340/721 OR

*Primary Examiner*—Jeffery A. Brier

*Attorney, Agent, or Firm*—Donald B. Paschburg; Howard G. Massung

[57] ABSTRACT

A digital blanker for scanned displays is provided which turns off the electron beam on a Cathode Ray Tube whenever the beam is in a pre-defined area on the screen. A high speed analog to digital converter is utilized to digitize the position of either a raster or randomly scanned CRT beam. Once the beam position is digitized, the resulting number is used as an address to an EPROM. The data in the EPROM is coded to cause the CRT beam to be blanked if the beam is positioned in the predefined area where blanking is required.

17 Claims, 2 Drawing Sheets

X DEFLECTION
X DEFLECTION AMPLIFIER
CLOCK
FLASH ANALOG TO DIGITAL CONVERTER DATA OUT
CLIPPER BLANK (FLIP-FLOP 16)
VIDEO SHIFT REGISTER
DIGITIZE SAMPLE N
EPROM LOOK UP FROM SAMPLE N
2
3
4
5
6
7
8
9
SAMPLE N-1
SAMPLE N
SAMPLE N+1
SAMPLE N+2
SAMPLE N+3
SAMPLE N+4
SAMPLE N+5
SAMPLE N+6
SAMPLE N+7
SAMPLE N
VIDEO DELAY
SAMPLE N

DIGITAL BLANKER FOR SCANNED DISPLAYS

BACKGROUND OF THE INVENTION

1. Field of the Invention

The present invention is related to the field of blanking either raster or randomly scanned displays and more particularly to an apparatus that turns off the electron beam on a Cathode Ray Tube (CRT) independently of the graphics generator whenever the beam is in a predefined area on the screen.

2. Description of the Prior Art

The prior art contains various types of displays. These various types of displays utilize character generators which are either "stroke generators" or "dot matrix display generators". In a dot matrix type display, characters are formed by sequentially generating a series of discreet spots at predetermined coordinate locations to thereby form an image of the character. In a stroke generator or randomly scanned type display, an alphanumeric character is presented by generating incremental line segments which when connected together create a visual presentation of a desired character. The present invention is applicable to either type of display, however, the primary use of this invention will be on a stroke generator type display.

In a typical CRT raster scanned visual display system, an image is generated by allowing a scanning electron beam to strike the phosphor on the face of the cathode ray tube only at selected locations and by blanking or keeping off the electron beam as it scans over all other locations. To maintain an image generated in this manner on the cathode ray tube, it is necessary for the electron beam continuously to repeat the same data. To allow this repeated scanning, the data must be stored in a memory. In order to be able to address any point on the face of the cathode ray tube, the memory must contain M storage positions, where M is equal to the number of scan lines per frame, times the number of elements of resolution in one scan line.

In CRT raster scanning visual display systems, the information to be displayed typically is provided by a microprocessor. This information is normally supplied to a CRT controller circuit which generates the horizontal and vertical display sync pulses as well as a display timing signal that determines the horizontal and vertical video blanking times which correspond to the occurrence of the horizontal and vertical sync pulses. In addition, the typical visual display system also utilizes a refresh memory circuit wherein information concerning the visual display to be provided in a single display frame is received from a microprocessor and stored for later recall by the operation of the CRT controller circuit. Also, such systems utilize a character generator which receives control signals from the CRT controller circuit and display information signals from the refresh memory circuit and in response thereto provides excitation signals to a video control circuit that determines the video excitation to be provided on the CRT screen. This video excitation comprises the timed activation of a scanning CRT electron beam gun to produce a desired display character at a desired location on the CRT screen.

U.S Pat. No. 4,663,618 by Hayles discloses an arbitrary raster blanking circuit. In this invention, the horizontal or X-axis and vertical or Y-axis deflection voltages of the raster signal are used to determine the beam position on the screen and then by using voltage comparators, it is determined if the beam is in a predefined area and if it is to blank the beam. By using voltage dividers, operational amplifiers (op amps), potentiometers and comparators it is possible to define and adjust the circuit for arbitrary shapes. Each different shape that is to be blanked would require it's own set of voltage dividers, op amps, potentiometers and comparators.

SUMMARY OF THE INVENTION

It is the objective of the present invention to develop a digital blanker for either raster or randomly scanned displays which occupies little printed circuit board area, uses fewer parts, is free of the drifts and aging that are normally found in an analog design and requires fewer initial adjustments. The most important object of the present invention is the use of an Erasable Programmable Read Only Memory (EPROM) in which the shapes of the blanked areas are stored. Since the shape and complexity of the blanked areas are stored in EPROM, they can be easily modified by merely changing the data in the EPROM. The blanked areas of the prior art, were defined by dedicated analog circuitry and to change the shape of the blanked areas meant changing resistor values, potentiometer settings, op amp gains etc. It is a further objective of the invention to allow many patterns to be stored in the EPROM as compared to adding analog circuits to generate additional blanking patterns.

These objectives are attained in the present invention by utilizing an electronic method to turn off the electron beam on a Cathode Ray Tube (CRT) whenever the beam is found to be in a predefined area on the screen. This invention includes a high speed Analog to Digital Converter to digitize the position of a randomly scanned CRT beam. Once the beam position is digitized the resulting number is used as an address to an Erasable Programmable Read Only Memory (EPROM). The data in the EPROM is coded to cause the CRT beam to be blanked if the beam is positioned in a predefined area where blanking is required.

This invention is applicable to any type of display scanning. However, the primary use of this circuit will be on a randomly scanned or stroked picture, which consists of a series of lines connecting predefined points to create symbols. Each line drawn can be represented as an angle and a length from a given starting point. Only the absolute position of the starting point of the first line of any symbol is known. Since some of the symbols that make up the picture can be rotated or translated they may overwrite other symbols or areas of the screen causing color shifts, unreadable characters or clutter. Under software control, any predefined area of the screen can be kept free of unwanted symbols by enabling the digital blanker. During the time a symbol is being drawn, that may overwrite areas where no data is to be displayed, the digital blanker detects when the CRT beam is in that area and turns the beam off.

DETAILED DESCRIPTION OF THE INVENTION

Figure 1:
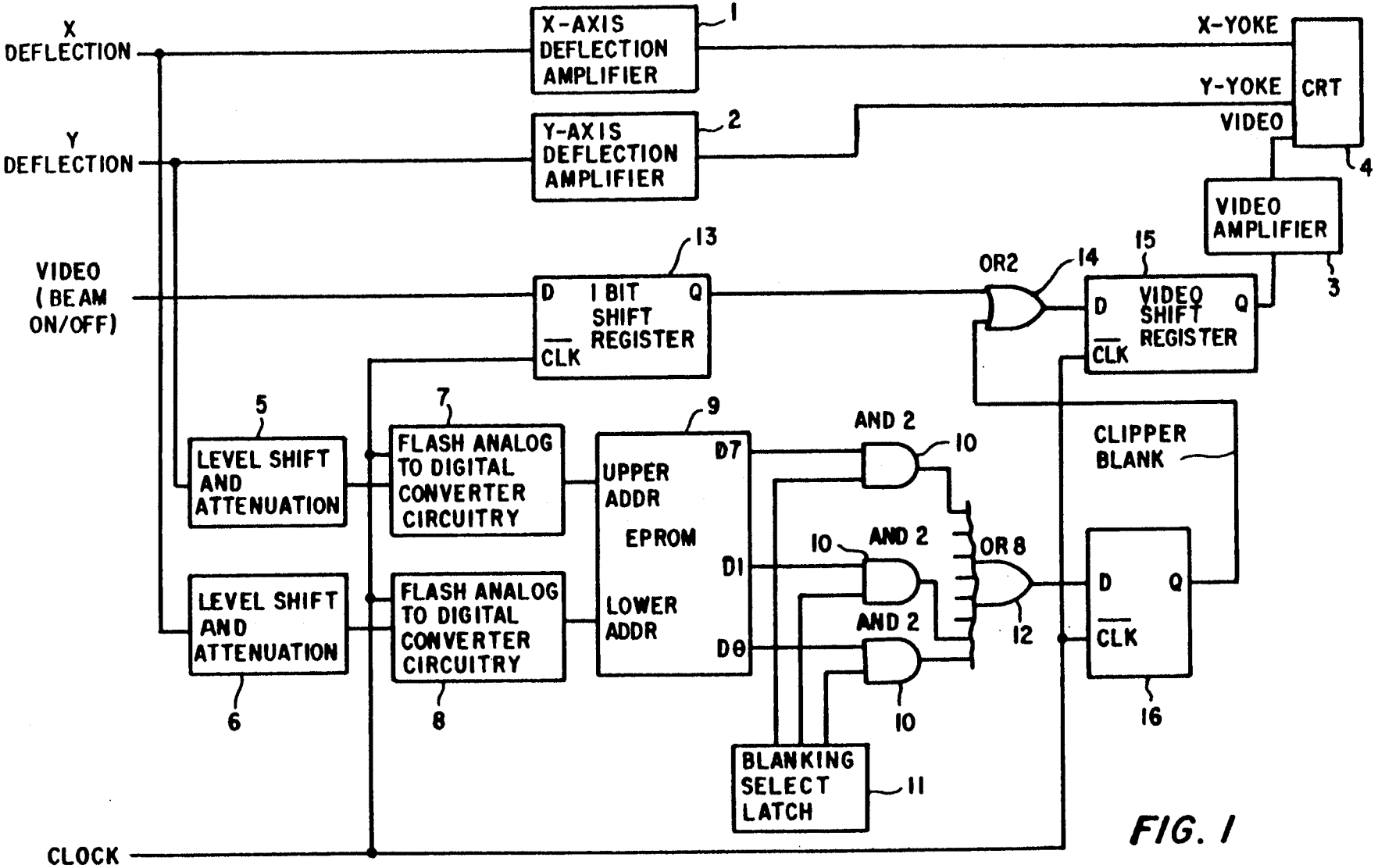
FIG. 1 illustrates a block diagram of the present invention.
Figures 2, 3, 4, 5, 6, 7:
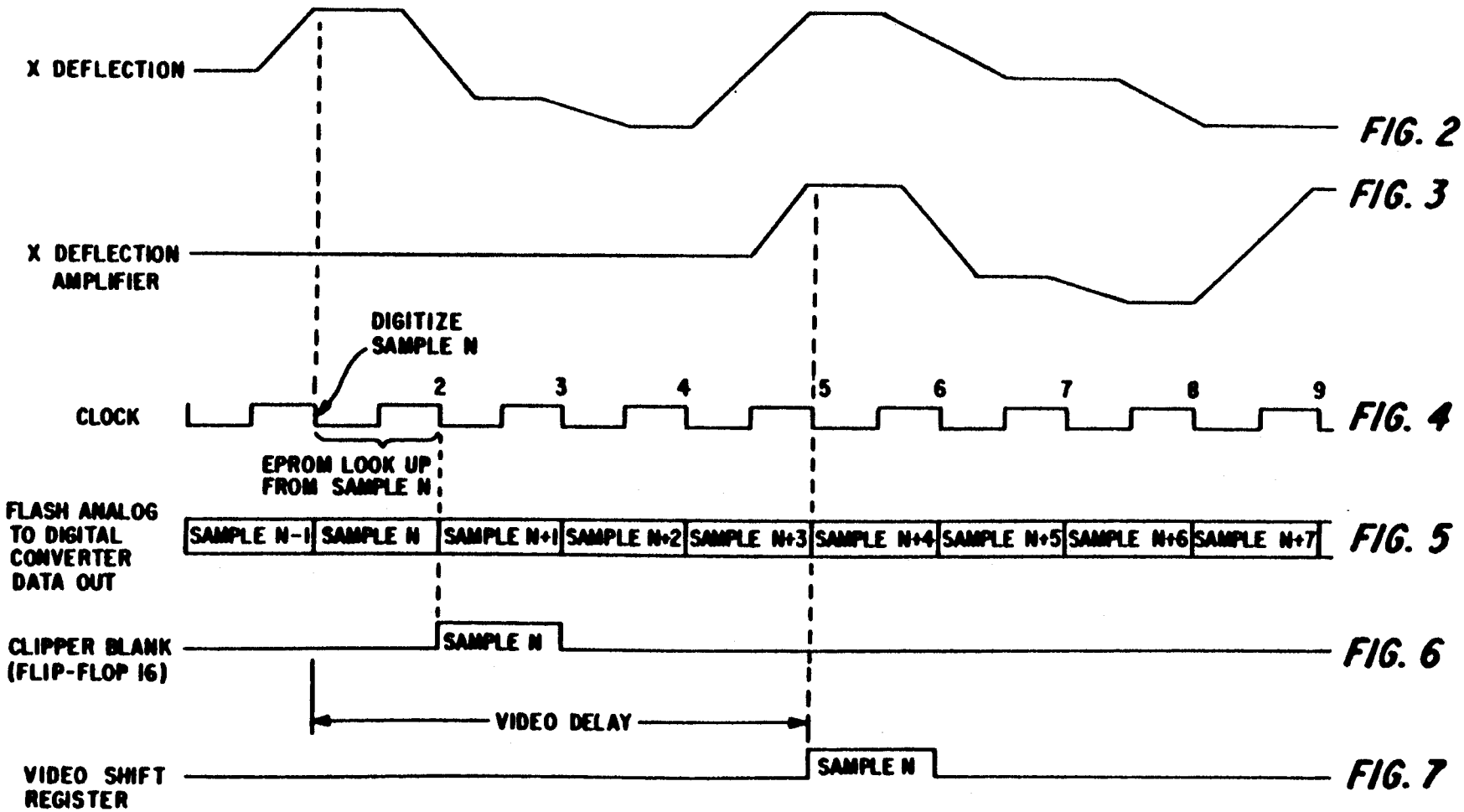
FIGS. 2–7 are timing diagrams for the present invention.

The primary use of this invention will be on a stroked picture which consists of a horizontal or X-axis deflection signal, a vertical or Y-axis deflection signal, and a video (beam on/off) signal. As illustrated in FIG. 1, the X-axis deflection signal passes through an X-axis deflection amplifier 1 and the Y-axis deflection signal passes through a Y-axis deflection amplifier 2, each of which has longer propagation delays than the video amplifier 3. Due to the difference in propagation delays through the deflection amplifiers 1,2 and the video amplifier 3, it is necessary to delay the video signal in order to maintain synchronization between the two signals. This video delay is necessary to insure that the beam is turned on and off at the proper time while the beam is being moved along the phosphor of the CRT 4. In this system, the deflection signals and the video signals are related to one another and kept synchronized to each other by the system clock. This particular system requires that the video must be delayed by 4 clock cycles in order to turn the beam on and off at the proper times. The 1 Bit Shift Register 13, and the Video Shift Register 15, delay the video signals the necessary clock cycles. In order for this invention to work, the video delay must be at least 1 clock cycle long.

This invention uses the delay time to convert both the X-axis and Y-axis deflection signals into digital numbers, which represent the address of the beam on the CRT 4 at the time of the high to low transition of the clock. The digital numbers are then used as addresses into a preprogrammed table to determine if the beam is in an area where it is to be blanked, as determined by the data programmed into the EPROM 9. If that area is currently selected, the beam is turned off.

First the X-axis and Y-axis analog deflection signals flow through level shift and attenuation circuits 5,6 that are configured to attenuate a +5 to −5 volt input signal to +1 to −1 and then level shift the signal that was centered around 0.0 volts so that it now swings around +1.0 volts. This attenuation and level shifting is necessary so that the input voltages are at the proper levels to be within the conversion range of the flash Analog to Digital Converter (ADC) circuitry 7,8. These two conditioned analog signals are then converted into two 7 bit digital numbers by the ADC circuitry 7,8. Referring to FIGS. 2–7 during the high level of the clock the flash ADC circuitry tracks the conditioned input signal. When the clock transitions from a high to a low level, the signal just being tracked is converted into a 7 bit digital number and is available at the output of the ADC circuitry 7,8 (FIG. 1). The X-axis digital number is used as the lower half of the address lines to a table located in the EPROM 9, while the Y-axis digital number is used as the upper half of the address lines of the table located in the EPROM 9. When both of these digital numbers are combined, the resulting address represents a unique location (pixel) on the CRT 4. If that pixel is in an area where one desires the beam to be blanked, the data bit at that location is programmed to a logical "one".

For example, at every address there are 8 data bits which allow for 8 different blanking patterns to be programmed into the table of the EPROM 9. However, other memory configurations can provide for the storage of more blanking patterns. The output of the EPROM 9 is then logically "ANDed" by AND gates 10, with the output of the blanking select latch 11. The data stored in this latch determines which pattern or patterns have been selected. If for example, the third blanking pattern is selected, the third bit of the blanking select latch word is set to a logic "one". The outputs that result from this "ANDing" are then combined together by an OR gate 12, so that if the beam is in an area where blanking is desired, a logical "one" is created. By the time the clock signal transitions from high to low again, the X and Y converted numbers have addressed the EPROM, accessing data at that location. The data just accessed from the EPROM after being ANDed and ORed is set up at the "data" input of flip flop 16. On the next high to low transition of the clock (FIGS. 2–7), the data out of OR gate 12 is clocked into flip flop 16. This whole conversion process takes 1 clock cycle. The 1 Bit Shift Register 13, delays the video signal 1 clock cycle referenced to the high to low transition of the clock. OR gate 14 combines the video with the output of the flip flop 16 so that if either line is a logic "one" then a "one" is clocked into the Video Delay Line 15, by the next high to low transition of the clock. The Video Shift Register 15 then delays the video by 3 clock cycles (FIGS. 2–7) so that by the time the video signal is applied to the Video Amplifier 3 it has been delayed by 4 clock cycles, which is the same amount that the X-deflection and Y-deflection signals have been delayed by the X-deflection amplifier 1 and the Y-deflection amplifier 2.

The advantages this circuit has over the prior art are four. The invention uses fewer parts than the prior art, which means that less printed circuit board area is required. Most of the potentiometers and other analog components that were present in the prior art are eliminated which causes this circuit to be free of the drifts and aging that are normally found in those type of analog components. By eliminating the potentiometers that were necessary to align the blanking windows for each shape of the prior designs, this invention requires fewer initial adjustments. Since this invention is primarily used for randomly scanned displays, there is not a fixed pattern of voltages that drive the deflection amplifiers as there is in raster scanned displays. If there were, then determining the beam's position would be much easier. Using the flash ADC removes this limitation and allows the invention to digitize the position of the beam at any given position.

The primary advantage this invention has over the prior art, is the use of an Erasable Programmable Read Only Memory (EPROM) in which the shapes of the blanked areas are stored. Since the shape and complexity of the blanked areas are stored in EPROM, they can be easily modified by reprogramming the EPROM. To change the shapes of blanked areas using the approaches of the prior art meant readjusting a potentiometer or adding op amps, comparators and other circuitry necessary to implement the shape. This invention allows the blanked areas to be modified by merely changing the data in the EPROM as compared to adding hardware circuits to generate additional blanking patterns required by the prior art.

This invention has practical importance for any type of scanned display such as the stroke written electronic displays in aircraft, CRT based computer graphic displays, oscilloscopes, or any type of real time animation and some arcade video games.

It is not intended that this invention be limited to the hardware arrangement, or operational procedures shown disclosed. This invention includes all of the alterations and variations thereto as encompassed within the scope of the claims as follows.

We claim:

1. A digital blanker for scanned displays comprising:

electronic circuitry means for digitizing a position of a scanned CRT beam;

storage means for recording a predefined area of the scanned display where blanking is required;

comparison means connected to said storage means for comparing the digitized position of the scanned CRT beam with the predefined area where blanking is required; and means for applying an output of said comparison means to blank said predefined area of a CRT.

2. A digital blanker for scanned displays as defined in claim 1 wherein said electronic circuitry means comprises:

level shift and attenuation means which are connected to analog to digital converter circuitry means.

3. A digital blanker for scanned displays as defined in claim 2 wherein said storage means comprises:

erasable programmable read only memory means, said storage means being connected to the output of said analog to digital converter circuitry means.

4. A digital blanker for scanned displays as defined in claim 3 wherein said comparison means comprises:

blanking select latch means which is connected to first gate means.

5. A digital blanker for scanned displays as defined in claim 4 wherein said storage means is interposed between said analog to digital converter circuitry means and said first gate means, said storage means comprising:

an addressed memory array with a plurality of addressed storage registers, each of said storage registers being capable of storing a coded combination of bits.

6. A digital blanker for scanned displays as defined in claim 1 wherein said means for applying an output of said comparison means to blank said predefined area of a CRT comprises:

second and third gate means, on both sides of flip flop means;

video shift register means; and, video amplifier means which together provide a video blanking input to a CRT.

7. A digital blanker for scanned displays comprising:

an X-axis deflection input;

a Y-axis deflection input;

a video input;

a clock input;

electronic circuitry means for digitizing said X-axis deflection input and said Y-axis deflection input to obtain a digitized position of a scanned CRT beam;

storage means for recording a predefined area of the scanned display where blanking is required;

comparison means connected to said storage means for comparing the digitized position of the scanned CRT beam with the predefined area where blanking is required; and, means for applying an output of said comparison means to blank said predefined area of a CRT.

8. A digital blanker for scanned displays as defined in claim 7 further comprising:

deflection means connected to said X-axis deflection input and said Y-axis deflection input, said deflection means comprising:

horizontal and vertical deflection amplifiers.

9. A digital blanker for scanned displays as defined in claim 8 wherein said horizontal and vertical deflection amplifiers act as delay means.

10. A digital blanker for scanned displays of a CRT comprising:

an X-axis deflection input;

a Y-axis deflection input;

a video input;

a clock input;

deflection means connected to said X-axis deflection input and said Y-axis deflection input, said deflection means comprising horizontal and vertical deflection amplifiers;

first shift register means connected to said video input and said clock input for coordinating the timing of said video input;

electronic circuitry means connected to said X-axis deflection input, said Y-axis deflection input and said clock input for digitizing said X-axis deflection input and said Y-axis deflection input to obtain a digitized position of a scanned CRT beam;

storage means for recording a predefined area of the scanned display where blanking is required;

blanking select latch means for determining which pattern has been selected;

first gate means coupled to said storage means and said blanking select latch means for ANDing an output of said storage means with an output of said blanking select means;

second gate means coupled to said first gate means for ORing together outputs of said first gate means;

flip flop means coupled to said second gate means and said clock input for coordinating timing of an output of said second gate means;

third gate means coupled to said flip flop means and said first shift register means for ORing together an output of said flip flop means with an output of said first shift register means;

video shift register means connected to an output of said third gate means and said clock input for coordinating timing of video blanking signal; and, video amplifier means connected between said video shift register means and said CRT for amplifying the video blanking signal, said amplified video blanking signal controls blanking of video on said CRT.

11. A digital blanker for scanned displays as defined in claim 10 further comprising:

a CRT which receives an amplified X-axis deflection signal, an amplified Y-axis deflection signal and an amplified video blanking signal and provides a composite visual display frame in accordance therewith.

12. A digital blanker for scanned displays as defined in claim 10 wherein said electronic circuitry means comprises:

level shift and attenuation means which are connected to analog to digital converter circuitry means.

13. A digital blanker for scanned displays as defined in claim 12 wherein said storage means comprises:

erasable programmable read only memory, said storage means connected to the output of said analog to digital converter circuitry means.

14. A digital blanker for scanned displays as defined in claim 12 wherein said analog to digital converter circuitry means comprises:

flash analog to digital converters.

15. A digital blanker for scanned displays as defined in claim 10 wherein said horizontal and vertical deflection amplifiers each have longer propagation delays than said video amplifier means.

16. A digital blanker for scanned displays as defined in claim 10 wherein said electronic circuitry means connected to said X-axis deflection input and said Y-axis deflection input converts both the X-axis deflection input and the Y-axis deflection input into digital numbers which represent an address of a beam on said CRT.

17. A method of digitally blanking a scanned display of a CRT comprising:

digitizing a position of a scanned CRT beam;

recording a predefined area of the scanned display where blanking is required;

comparing the digitized position of the scanned CRT beam with the predefined area where blanking is required; and, applying comparison results to said CRT to blank said predefined area of said CRT.

* * * * *